US008143507B2

(12) United States Patent
Good et al.

(10) Patent No.: US 8,143,507 B2
(45) Date of Patent: Mar. 27, 2012

(54) ADJUSTING DEVICE FOR SNARE DRUM

(75) Inventors: John J. Good, Thousand Oaks, CA (US); Richard A. Sikra, Thousand Oaks, CA (US)

(73) Assignee: Drum Workshop, Inc., Oxnard, CA (US)

( * ) Notice: Subject to any disclaimer, the term of this patent is extended or adjusted under 35 U.S.C. 154(b) by 0 days.

(21) Appl. No.: 12/657,180

(22) Filed: Jan. 19, 2010

(65) Prior Publication Data

US 2011/0120286 A1 May 26, 2011

Related U.S. Application Data

(63) Continuation-in-part of application No. 12/592,208, filed on Nov. 20, 2009, now Pat. No. 7,902,444.

(51) Int. Cl.
*G10D 13/02* (2006.01)

(52) U.S. Cl. ..... 84/413

(58) Field of Classification Search ..... 84/411 R, 84/413–417

See application file for complete search history.

(56) References Cited

U.S. PATENT DOCUMENTS 4,339,982 A * 7/1982 Hoshino ..... 84/415
2009/0133564 A1* 5/2009 Miyajima ..... 84/415

* cited by examiner

*Primary Examiner* — Kimberly Lockett
(74) *Attorney, Agent, or Firm* — William W. Haefliger

(57) ABSTRACT

In combination with a snare drum having snare wires, a drum head and a side wall, slidable bands endwise connected with the wires, first adjustable mechanism connected with the a band end, and supported by the wall, second adjustable mechanism connected with another band end, and supported by said wall, whereby adjustment of either or both of the mechanism tensions at least one band, and said snare wires.

27 Claims, 10 Drawing Sheets

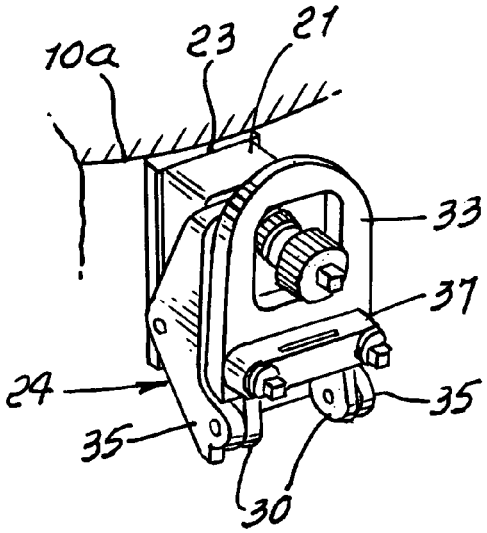
FIG. 2.
FIG. 3.
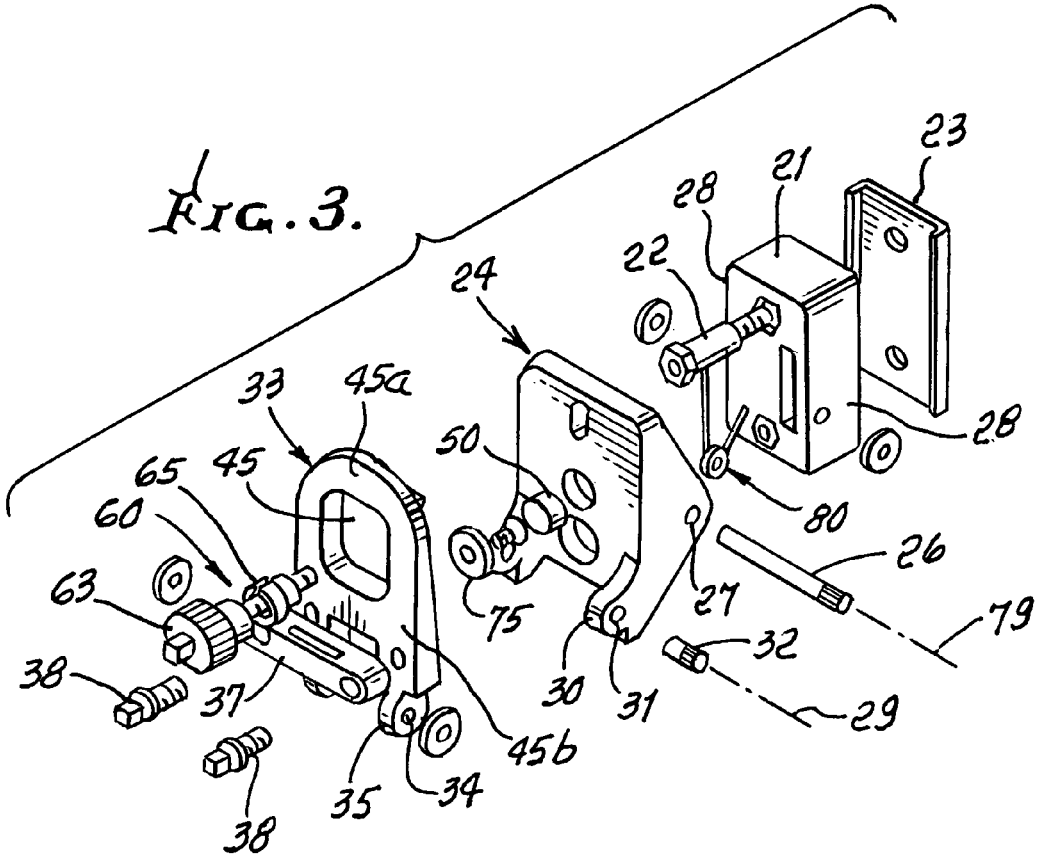

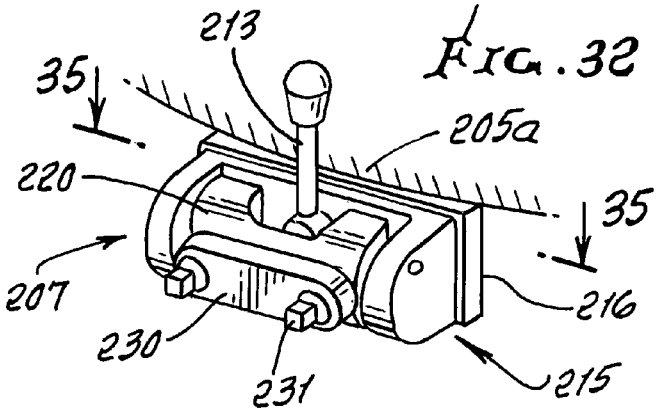
FIG. 32
FIG. 34
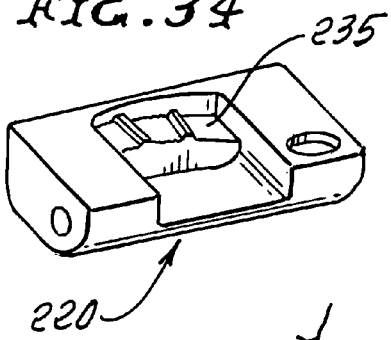
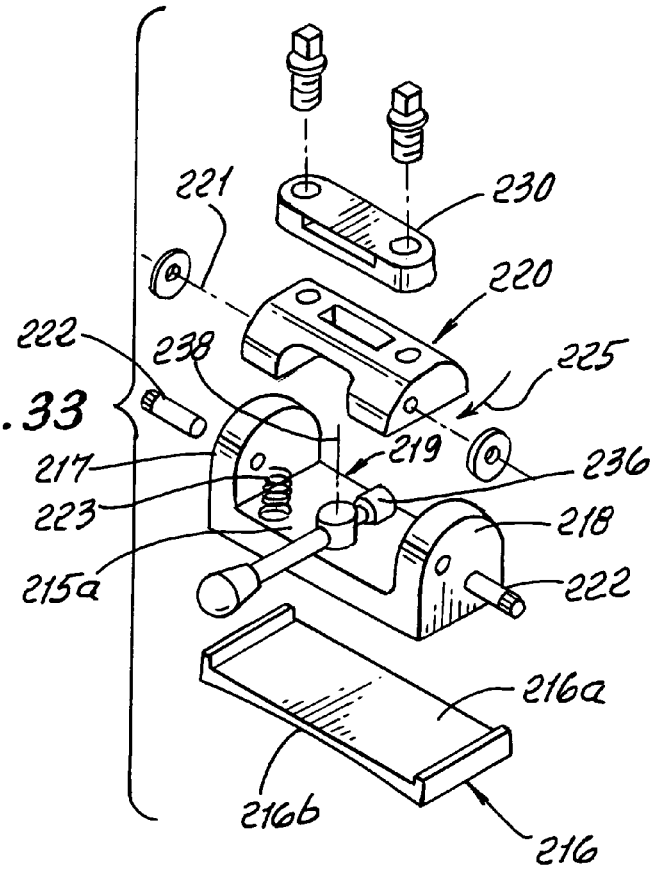
FIG. 33

ADJUSTING DEVICE FOR SNARE DRUM

This application is a continuation-in-part of Ser. No. 12/592,208, filed Nov. 20, 2009 now U.S. Pat. No. 7,902,444.

BACKGROUND OF THE INVENTION

This invention relates generally to drumming apparatus, and more particularly to improvements to auxiliary apparatus attachable to a drum, such as a snare drum, in respect of tensioning and releasing of multiple strands that co-act with a drum head to produce desired acoustic effects.

U.S. Pat. No. 5,616,875 discloses apparatus of this general character. There is need for improvements in lever controlled tensioning and de-tensioning of the multiple strands as well as enabling lever captivation in strand tensioned condition, as are disclosed herein.

SUMMARY OF THE INVENTION

It is a major object of the invention to provide improved apparatus as referred to, for use in tensioning and de-tensioning drum snare wires, and wherein an endwise slidable tensioning band is employed. The invention contemplates provision of at least one, and preferably two tension adjusting mechanisms connected to a drum side wall. One of such mechanisms basically comprises the invention a) a first mount connectable to said side wall, b) a pivoted support carried by the mount, to be connected with said slidable element for endwise displacing said element, c) and mechanism including a handle carried by the mount, and cam structure operatively connected between the handle and said support for effecting controlled endwise displacement of the slidable element in response to manually controlled movement of the handle acting to pivot said support.

As will be seen, the handle preferably freely projects for pivoting, and may comprise a lever or joystick.

Another object is provision of the cam structure to form a ramp associated with the pivoted support, and a pusher engaging the ramp and movable relatively lengthwise thereof in response to said handle movement. In this regard, the pusher may comprise a roller on the handle to rollably engage, and progressively deflect, the ramp and pivoted support, thereby to adjustably and progressively tension the slidable band. Projections may be provided on the ramp to retain the roller in selected tensioning position, enabling operation of the other or second adjustable mechanism to tension a band or bands to "fine tuned" snare wire tensioned state.

The second mechanism may include:

a) a second mount connectable to a drum such as a snare drum side wall, b) a support arm having operative adjustable connection to the mount, c) a second handle operatively pivotally connected to the support arm, and also operatively connected to the slidable band, the handle having an extended position in which the band is endwise loosened so that the snare wires are loosened, and also having a retracted position in which the band is endwise tightened so that the snare wires are tensioned adjacent the drum head.

As will be seen, the operative adjustable connection of the support arm to the second mount typically comprises a pivoted connection allowing the support arm to be adjustably pivoted about a first axis which is parallel to a second axis defined by second handle pivoted connection to the support arm.

Another object is to provide a band connection to the second handle at an adjusted location, there being provision for magnetic retention of the second handle in retracted position, to retain tensioning of the band.

A further object is to provide a rotatable adjuster connected to at least one of the mount and support arm, to adjust the pivoted position of the support arm relative to the second mount, whereby the pivoted positions of the second handle as in retracted and extended positions is or are adjusted. The second handle may be bifurcated to receive projected extent of the adjuster, the projected extent then being manually graspable to rotate the adjuster in handle retracted position. Also, the band may consist of low friction, synthetic resinous material.

The drum typically has an end ring extending about the head, the band or bands having sliding engagement with the ring; the adjuster being located remotely from such slidable band.

Another object is to provide, in combination:

a) slidable bands endwise connected with the snare wires, b) first adjustable mechanism connected with a band end, and supported by said drum wall, c) second adjustable mechanism connected with another band end, and supported by said wall, d) whereby adjustment of either or both of said mechanisms controllably tensions at least one band, and said snare wires.

One of such mechanism typically includes a magnetic holder for retaining the one mechanism in band tension retention mode; and the other mechanism typically includes a joystick positioned for manually adjusting tensioning of a band or bands, as between selected levels.

These and other objects and advantages of the invention, as well as the details of an illustrative embodiment, will be more fully understood from the following specification and drawings, in which:

DRAWING DESCRIPTION

FIG. 2 is a perspective view of the FIG. 1 apparatus;

FIG. 3 is an exploded view of components of the apparatus;

FIG. 32 is a perspective view of the "butt plate" tensioning mechanism, as shown in FIG. 3;

FIG. 33 is an exploded view of the components of the FIG. 32 mechanism;

FIG. 34 is a perspective view of a pivoted or pivotable support (swivel block) also shown in FIG. 23, but additionally showing an internal ramp;

DETAILED DESCRIPTION

Figure 1:
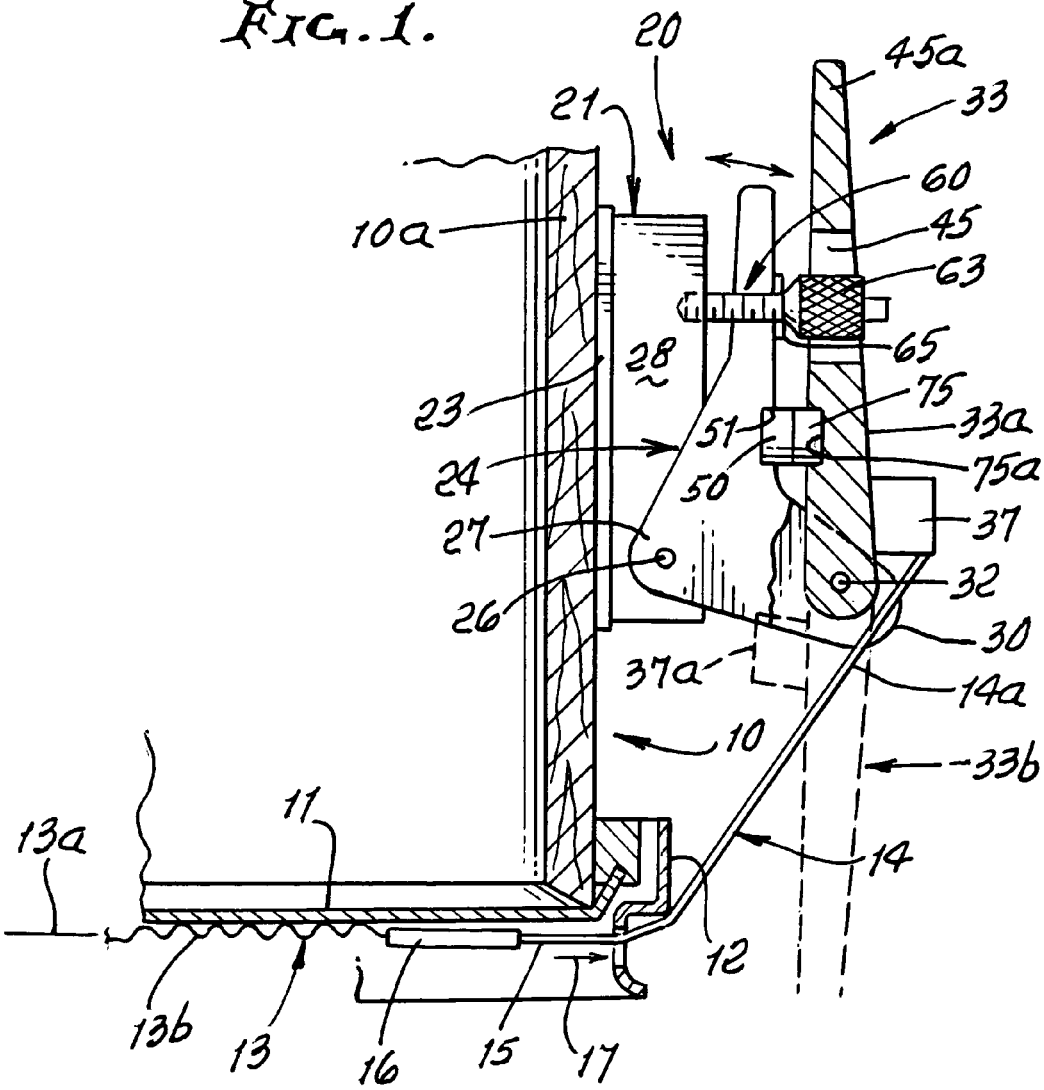
FIG. 1 is a schematic side view of apparatus incorporating a preferred form of the invention.
Figure 4:
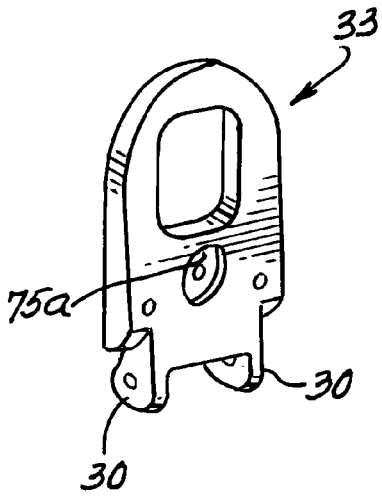
FIG. 4 is a perspective view of the apparatus handle.

Referring first to FIGS. 1-3, a drum 10 has an annular side wall or shell 10*a* typically wooden, and a head 11 at one end of the shell, for example the lower end. A metallic ring 12 is provided to extend on and about the shell. A group 13 of snare wires 13*a* extends transversely across the head lower side, with snares 13*b* positioned to impact the head. A thin plastic tensioner band 14 is end connected at 15 to a fitting 16 to which the wires are endwise connected. That band extends toward and over the ring to slide endwise under force application, to tension the snare wires as the band is pulled in direction 17, and to loosen the wires as tensioning is released. Band 14 typically consists of low sliding friction, synthetic resinous material.

In accordance with the invention, an improved throw-off assembly 20 is provided at the side of the shell. It includes a mount or base 21 connectable to the side wall 10*a*, as by fasteners such as jackscrews 22. A gasket 23 may be provided to fit between the base and side wall.

Figure 14:
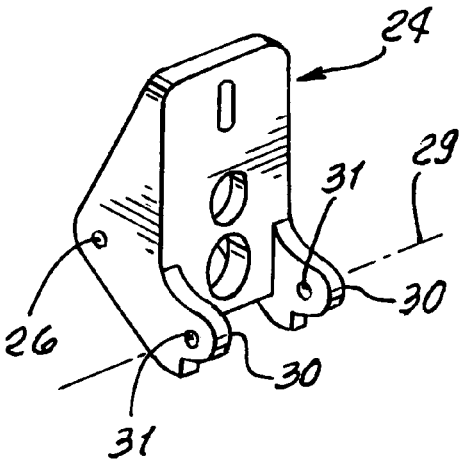
FIG. 14 is a perspective view of the support arm, as also seen in FIG. 1.
Figure 15:
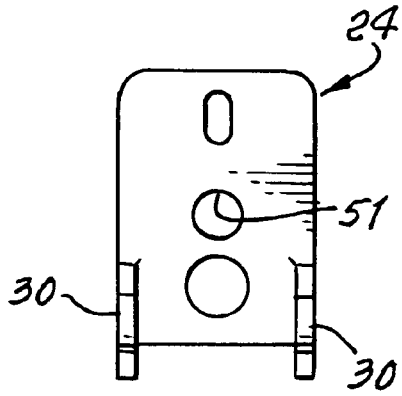
FIG. 15 is a frontal view of the FIG. 14 support arm.
Figure 16:
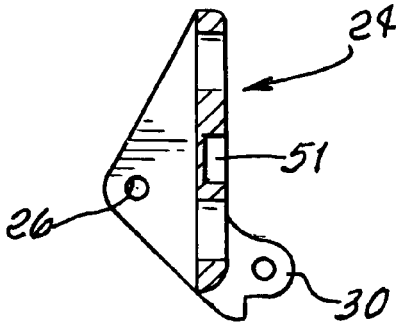
FIG. 16 is a left side view of the FIG. 15 arm.
Figure 17:
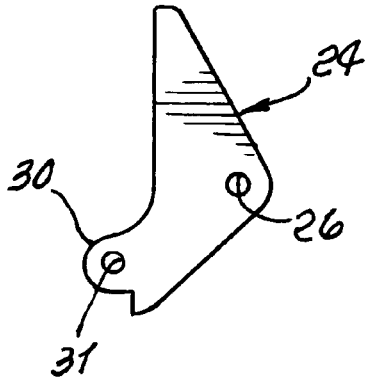
FIG. 17 is a right side view of the FIG. 15 arm.
Figure 18:
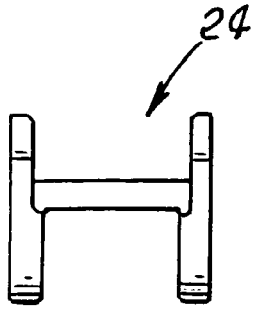
FIG. 18 is a bottom plan view of the FIG. 15 arm.
Figure 19:
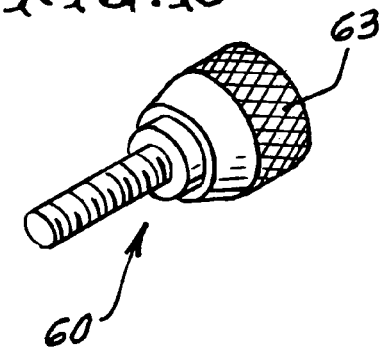
FIG. 19 is a perspective view of an adjuster having a manually rotatable throw-off knob.
Figure 24:
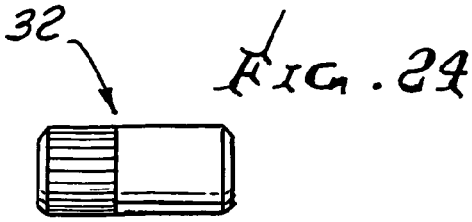
FIG. 24 is a side view of a small throw-off pin.
Figure 25:
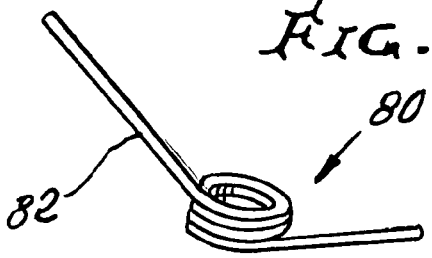
FIG. 25 is a perspective view of a throw-off torsion spring.
Figure 26:
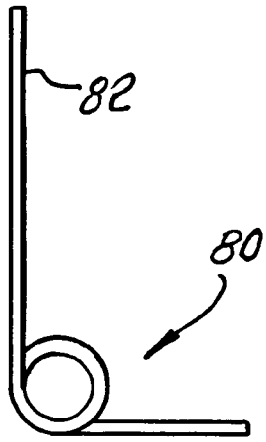
FIG. 26 is a side view of the FIG. 25 spring.
Figure 27:
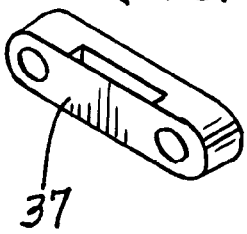
FIG. 27 is a perspective view of a throw-off strap plate.
Figure 28:
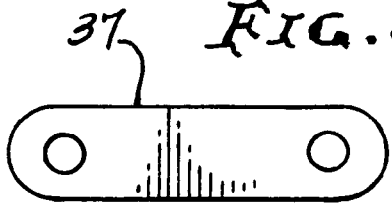
FIG. 28 is a frontal view of the FIG. 27 plate.
Figure 30:
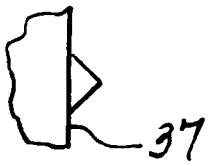
FIG. 30 is a section taken on lines 30-30 of FIG. 28.
Figure 29:
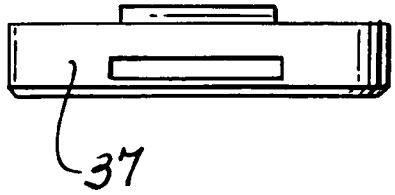
FIG. 29 is a top plan view of the FIG. 28 plate.
Figure 31:
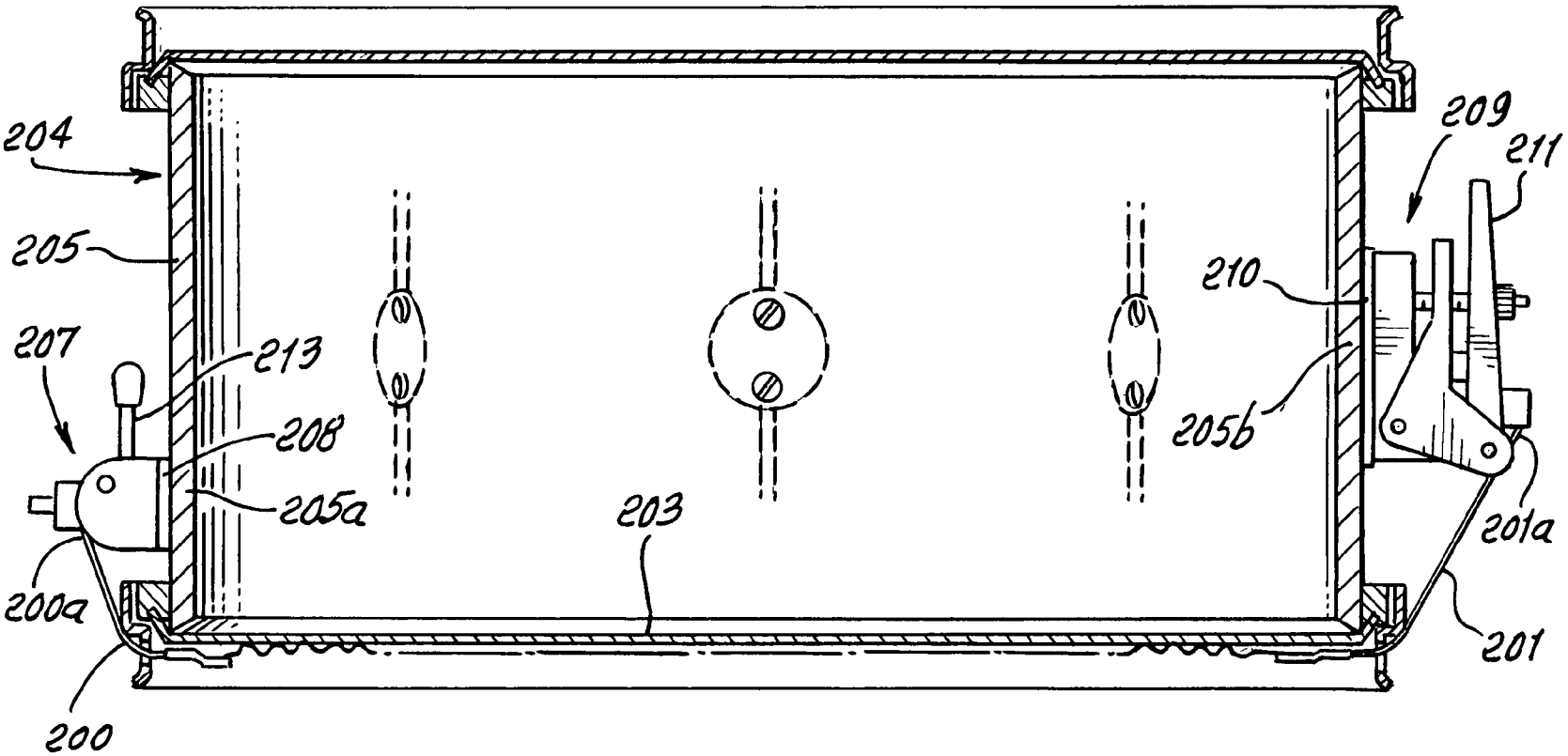
FIG. 31 is an elevation showing two different but related mechanisms attached to a snare drum wall, for adjustably tensioning the same snares and/or same wires.

A support arm 24 such as a saddle is provided outwardly of the base, to be operatively connected with the base, as by a pin member, typically in the form of an elongated swivel pin 26 defining axis 79. That pin projects through saddle flanges 27 that project toward mount 21 and that straddle opposite sides 28 of the mount, whereby the saddle or arm can pivot relative to the saddle about a transverse axis 29 defined by pin 26. Arm 24 also has two projections 30 which are transversely spaced and define axially aligned holes or openings 31 that receive pivot pins 32. See FIGS. 3, 14 and 24. Axes 29 and 79 are parallel.

A throw-off handle 33 is operatively pivotally connected to the arm 24, as by pins 32 that also project through transversely aligned holes 34 in projections 35 at one end of the handle. The handle is also connected with, or connectable to, an end 14*a* of the band 14, as via a strap plate 37 projecting at the side 33*a* of the handle in a direction opposite the arm or saddle 24. Plate 37 is connected with the handle as by threaded fasteners 38, whereby the band position relative to the handle can be endwise adjusted, for adjusting snare engagement with the drum head.

The handle has a pivoted extended position, hanging as indicated at 33*b* in FIG. 1, in which the strap plate 37 is positioned at 37*a* relatively closer to the ring 12, whereby the band 14 is loosened relatively endwise so that the snare wires and snares are downwardly loosened relative to the drum head to hang downwardly away from that head. The handle also has an upwardly pivoted retracted position indicated at 33*b* in FIG. 1 in which the band 14 is tightened so that the snare wires are tensioned adjacent the drum head, in active play position.

Figure 5:
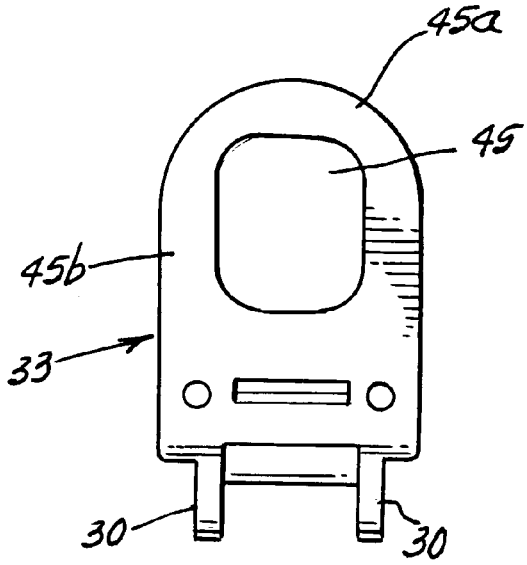
FIG. 5 is a frontal view of the handle.
Figure 6:
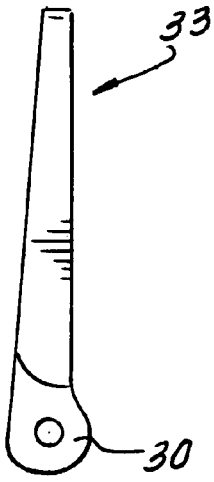
FIG. 6 is a left side view of the FIG. 5 handle.
Figure 7:
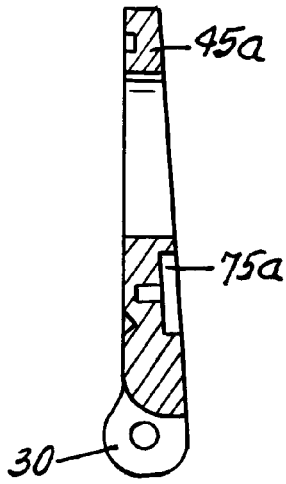
FIG. 7 is a right side view of the FIG. 5 handle.
Figure 8:
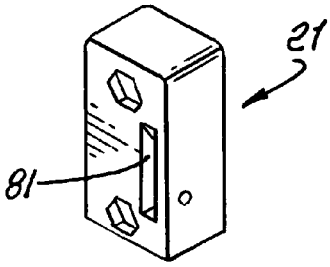
FIG. 8 is a perspective view of a mount connectable to the side of a snare drum.
Figure 13:
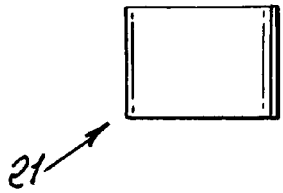
FIG. 13 is a top view of the FIG. 9 mount.
Figure 12:
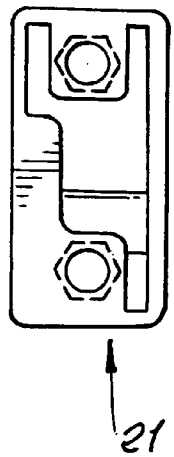
FIG. 12 is a rear view of the FIG. 9 mount.
Figure 10:
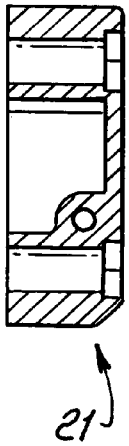
FIG. 10 is a left side view of the FIG. 9 mount.
Figure 9:
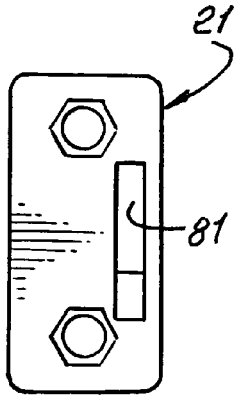
FIG. 9 is a frontal view of the FIG. 8 mount.
Figure 11:
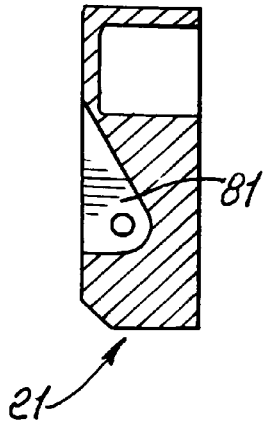
FIG. 11 is a right side view of the FIG. 9 mount.

For this purpose, the handle is typically bifurcated at 45, (see FIGS. 1, 3 and 5) to enable ease of manual grasping, as at handle bridge 45*a* connected with spaced legs 45*b*. A magnet 50, is fitted in opening 51 in arm 24, to register with and attract an insert steel disc 75 in the handle body portion recess 75*a* when the handle is swung to retracted position. Therefore, the handle is removably held in retracted position, to prevent inadvertent handle swinging to downwardly extended position, and loosening of the snares, from their drum playing position.

Figure 20:
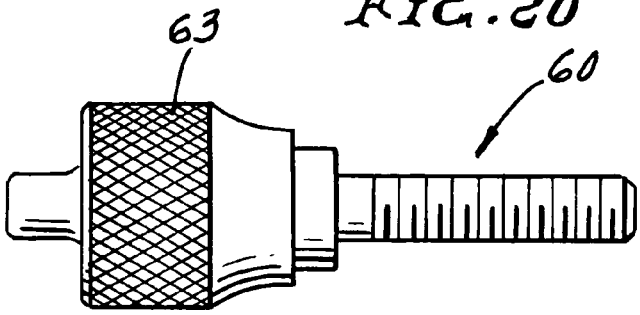
FIG. 20 is a side view of the FIG. 19 adjuster.
Figure 21:
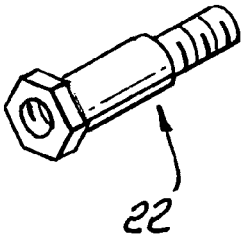
FIG. 21 is a perspective view of a throw-off receiver/jackscrew.
Figure 22:
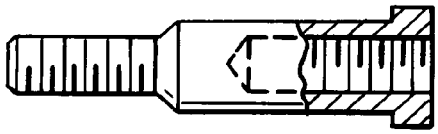
FIG. 22 is a side view of the jackscrew of FIG. 21.
Figure 23:
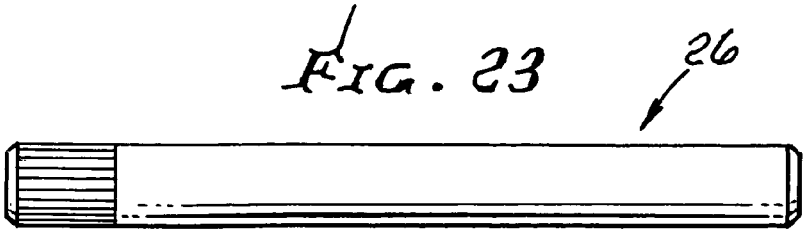
FIG. 23 is a side view of a large throw-off pin.

Also provided is an adjuster 60 (see FIGS. 3 and 20) rotatably connected to the mount 21 and support arm 24, to adjust the pivoted position of the support arm relative to the mount, whereby the pivoted position of the handle in said retracted and extended positions is adjusted, for fine tuning of the snare positions relative to the drum head. The adjuster is shown in the form of a fastener projecting through the opening 45 formed by the handle bifurcation and may also be connected to the top of the receiver base 21. Opening 45 is sufficiently large as to enable user finger access to and manual rotatable adjustment of the adjuster knob 63, partially received in opening 45, and also to accommodate handle swinging between retracted and extended positions, without interference with the adjuster. A pressure insert, such as a rubber washer 65 on the adjuster is compressed between 63 and 24 to prevent axial looseness of the connection between the arm and mount, during rotatable and rotated adjustment of the adjuster. A torsion spring 80 fits in an elongated recess 81 in the mount 21. Spring leg 82 projects from the recess and bears against arm 24 to bias it and the magnet toward the handle and steel disc, in FIG. 1. This assures magnetic attraction of the handle in all tilt positions of the arm 24.

FIGS. 4-30 show detailed constructions and configurations of the above numbered elements, which provide unusual advantages in their operation and results, in terms of ease and accuracy of band adjustment and positioning.

The handle, arm and mount elements may consist of molded plastic material.

Referring now to FIGS. 31-36, FIG. 31 shows, basically, a) slidable bands 200 and 201 (like band 101) endwise connected to snare wires 202 extending adjacent head 203 of drum 204. A drum annular side wall is shown at 205. A first adjustable mechanism 207 (butt plate mechanism) is shown as carried at 208 by wall portion 205*a* and as connected with band end 200*a*; and second adjustable mechanism 209 is shown as carried at 210, by end wall portion 205*b*, remote from 205*a*, and connected with band end 201*a*. The configuration is such that adjustment of either or both of mechanisms 207 and 209 serves to tension at least one of the bands, and the snare wires connected between and to the bands. In a preferred example mechanism 207 adjusts band tension between discrete levels, whereas mechanism 209 adjusts (fine tunes) tension between such levels.

In the preferred combination, mechanism 209 may be of the form disclosed in FIGS. 1-29, having a magnetic holder for retaining that mechanism in band tension retention mode, or in release mode, depending upon the up-down positioning of a "throw-off" handle 211 (like first handle 33 in FIG. 1).

Mechanism 207 may be of the form disclosed in FIGS. 32-36, and include or provide an upwardly projecting lever or joystick 213 positioned for pivoting generally horizontally forwardly and rearwardly, for adjustably setting the tensioning of the band or bands, at a selected level or levels. Thus mechanism 207 provides a very easily adjusted "coarse"

adjustment of snare band tensioning at one side of the drum; and mechanism 209 provides a fine adjustment of snare tensioning, at the opposite side of the drum, the up-down and forward and rearward mode adjustments being easily and differently self-identifying to the drummer, enabling rapid and accurate adjustment during drum beating sequences, as during marching.

More specifically, and referring to the mechanism 207, and as shown in FIGS. 32-36, a first mount or bracket 215 is connected or connectable to drum side wall portion 205*a*. An intermediate gasket 216 has flat and curved opposite sides 216*a* and 216*b* to accommodate to the flat side of 215, and the curved outer side, of the drum wall. Mount or bracket 215 has flanges 217 and 218 at opposite ends of space 219 that receives a pivoted support block 220. The horizontal axis 221 of block pivoting relative to 215 is defined by pivot pins 222. A compression spring 223 is fitted between 220 and base 215*a* of 215, to urge 220 to pivot clockwise (see arrow 225) about axis 221, in FIG. 33.

Figure 35:
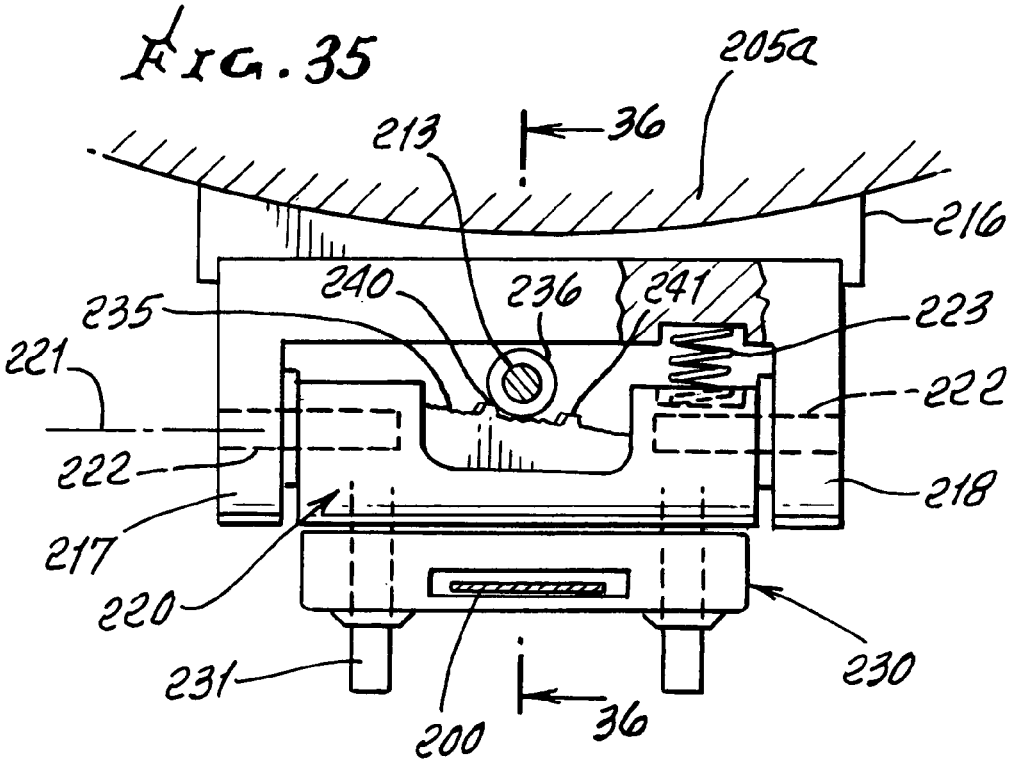
FIG. 35 is a plan view taken on line 35-35 of FIG. 32.

Such pivoting, effected by manual pivoting of joystick handle 213, serves to vary the "coarse" tensioning of the band 200, connected to the snare wires, as referred to, by means of generally upward rotation (in FIG. 32) of a band clamp 230 attached at 231 to the support 220. Cam structure is operatively connected between the handle 213 and support 220 to effect such rotation or pivoting of 220 in response to pivoting of joystick handle 213. The cam structure preferably includes a lengthwise extending and angled ramp 235 carried by support or block 220, and a pusher, as for example a roller 236 carried at the end of the joystick, to engage the ramp as seen in FIGS. 33 and 35.

The roller presses and rolls on the ramp, offset from axis 221, as shown in FIG. 34, as the joystick pivots about axis 238, whereby the support 220 is controllably pivoted about axis 221. Projections 240 and 241 spaced along the ramp act to retain the roller at a predetermined selected position, corresponding to predetermined positions of pivoting of the support 220, and predetermined tensioning levels of the band 201.

Accordingly, very simple, easily and accurately used, band tensioning structure is provided, at opposite sides of the drum, for ease and accuracy of snare activation and de-activation.

The components 215, 220 and 230 shown in FIG. 32 may consist of molded plastic material.

Figure 36:
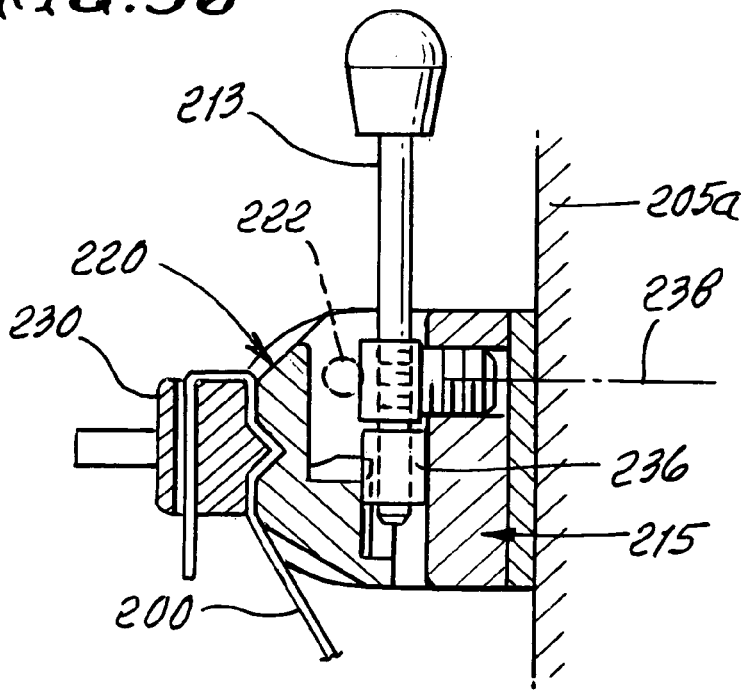
FIG. 36 is a section taken on lines 36-36 of FIG. 35.

As shown in FIG. 33 and FIG. 36, the joystick axis 238 of pivoting extends in perpendicularly offset relation to the support 220 axis 221 of pivoting, to provide a compact, accurately functioning assembly.

We claim:

1. For combination with a snare drum having a side wall, a head, snare wiring extending adjacent the head, and a slidable elongated element operatively connected with the snare wiring, an assembly that comprises:

a) a first mount connectable to said wall, b) a pivoted support carried by the mount, to be connected with said slidable element for endwise displacing said element, c) and mechanism including a handle carried by the mount, and cam structure operatively connected between the handle and said support for effecting controlled endwise displacement of the slidable element in response to manually controlled movement of the handle acting to pivot said support, d) said cam structure including a ramp associate with said pivoted support, and a pusher engaging the ramp and movable relatively lengthwise thereof in response to said handle movement.

2. For combination with a snare drum having a side wall, a head, snare wiring extending adjacent the head, and a slidable elongated element operatively connected with the snare wiring, an assembly that comprises:

a) a first mount connectable to said wall, b) a pivoted support carried by the mount, to be connected with said slidable element for endwise displacing said element, c) and mechanism including a handle carried by the mount, and cam structure operatively connected between the handle and said support for effecting controlled endwise displacement of the slidable element in response to manually controlled movement of the handle acting to pivot said support, d) and wherein the handle is freely projecting and is a pivoted joystick.

3. The assembly of claim 2 wherein said cam structure includes a ramp associated with said pivoted support, and a pusher engaging the ramp and movable relatively lengthwise thereof in response to said handle movement.

4. For combination with a snare drum having a side wall, a head, snare wiring extending adjacent the head, and a slidable elongated element operatively connected with the snare wiring, an assembly that comprises:

a) a first mount connectable to said wall, b) a pivoted support carried by the mount, to be connected with said slidable element for endwise displacing said element, c) and mechanism including a handle carried by the mount, and cam structure operatively connected between the handle and said support for effecting controlled endwise displacement of the slidable element in response to manually controlled movement of the handle acting to pivot said support, d) and wherein said pusher comprises a roller on the handle.

5. The assembly of claim 4 wherein the handle comprises a pivoted joystick movable to displace the roller in response to joystick pivoting.

6. The assembly of claim 5 wherein the joystick has a first axis of pivoting, and the support has a second axis of pivoting, said axes extending in substantially perpendicular offset relation.

7. For combination with a snare drum having a side wall, a head, snare wiring extending adjacent the head, and a slidable elongated element operatively connected with the snare wiring, an assembly that comprises:

a) a first mount connectable to said wall, b) a pivoted support carried by the mount, to be connected with said slidable element for endwise displacing said element, c) and mechanism including a handle carried by the mount, and cam structure operatively connected between the handle and said support for effecting controlled endwise displacement of the slidable element in response to manually controlled movement of the handle acting to pivot said support, d) and including a spring carried by the mount to resist pivoting of the pivoted support.

8. The assembly of claim 7 wherein the spring is located between the pivoted support and a portion of the mount.

9. The assembly of claim 1 including projections on the ramp to be engaged by the pusher.

10. The assembly of claim 5 including projections on and spaced along the ramp to be engaged by the pusher.

11. For combination with a snare drum having a side wall, a head, snare wiring extending adjacent the head, and a slidable elongated element operatively connected with the snare wiring, an assembly that comprises:

a) a first mount connectable to said wall, b) a pivoted support carried by the mount, to be connected with said slidable element for endwise displacing said element, c) and mechanism including a handle carried by the mount, and cam structure operatively connected between the handle and said support for effecting controlled endwise displacement of the slidable element in response to manually controlled movement of the handle acting to pivot said support, d) and including said drum, the mount connected to the drum side wall at a first location.

12. The assembly of claim 11 including means carried by said drum remotely from said first mount for tensioning said slidable element.

13. The assembly of claim 11 including:

d) a second mount connected to said side wall at a second location remotely from the first mount, e) a support arm having operative adjustable connection to said second mount, f) and a second handle operatively pivotably connected to said element, the second handle having an extended position in which the element is endwise loosened so that the snare wires are loosened, and also having a retracted position in which the element is endwise tightened so that the snare wires are tensioned adjacent the drum head.

14. The assembly of claim 13 wherein said operative adjustable connection of the support arm to the second mound is a pivoted connection allowing the support arm to be adjustably pivoted about a first axis which is parallel to a second axis defined by said second handle pivoted connection to the support arm.

15. The assembly of claim 13 wherein the element is connected to said second handle at a location which is bodily displaced as the second handle is moved between said extended and retracted positions.

16. The assembly of claim 13 including an adjuster rotatably connected to at least one of the second mounted and support arm, to adjust the pivoted position of the support arm relative to the second mount, whereby the pivoted positions of the second handle in said retracted and extended positions is adjusted.

17. The assembly of claim 16 wherein the handle is bifurcated to receive projected extent of the adjuster, and projected extent then being manually graspable to rotate the adjuster.

18. The assembly of claim 15 wherein said location of element connection to the handle is at a side of the second handle facing away from the second mount.

19. The assembly of claim 13 including said element consisting of low friction, synthetic resinous material.

20. The assembly of claim 13 wherein the drum has an end ring extending about the drum head, the element having sliding engagement with the ring.

21. The assembly of claim 17 wherein said adjuster is located remotely from the element and ring.

22. The assembly of claim 13 including a magnet element and a steel insert element, one of the magnet and insert elements carried by the second handle and the other of the magnet and insert elements carried by said arm, said magnet and insert elements manually registering in second handle retracted position, to provide magnetic force operating to hold the second handle against inadvertent dislodgement from second handle retracted position, whereby snares are not then inadvertently loosened.

23. The assembly of claim 22 including a torsion spring carried by the second mount and having a spring leg biasing the arm and toward the handle, to position said insert and magnet elements toward effective magnetically mutually attracting positions, in tilted positions of the arm.

24. The assembly of claim 13 wherein the second handle, arm and second mount consist of molded plastic material, or aluminum, or steel.

25. In combination with a snare drum having snare wires, a drum head and a side wall, a) slidable bands endwise connected with the wires, b) first adjustable mechanism connected with a band end, and supported by said wall, c) second adjustable mechanism connected with another band end, and supported by said wall, d) whereby adjustment of either or both of said mechanisms tensions at least one band, and said snare wires, e) one of said mechanisms including a magnetic holder for retaining the mechanism in band tension retention mode.

26. The combination of claim 25 wherein one of said mechanisms includes a joystick positioned for manually adjusting tensioning of a band or bands.

27. The combination of claim 25 wherein another of said mechanisms includes a joystick positioned for manually adjusting tensioning of a band or bands.

* * * * *